US009951458B2

(12) United States Patent
Jo et al.

(10) Patent No.: US 9,951,458 B2
(45) **Date of Patent: *Apr. 24, 2018**

(54) WASHING MACHINE

(71) Applicant: LG ELECTRONICS INC., Seoul (KR)

(72) Inventors: Mingyu Jo, Seoul (KR); Seungchul Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 82 days.

This patent is subject to a terminal disclaimer.

(21) Appl. No.: 15/048,602

(22) Filed: Feb. 19, 2016

(65) Prior Publication Data

US 2016/0273148 A1 Sep. 22, 2016

(30) Foreign Application Priority Data

Mar. 20, 2015 (KR) ..... 10-2015-0038752
Mar. 20, 2015 (KR) ..... 10-2015-0038753

(51) Int. Cl.

| | |
|---|---|
| ***D06F 37/28*** | (2006.01) |
| ***D06F 37/22*** | (2006.01) |
| ***D06F 39/14*** | (2006.01) |
| *D06F 39/12* | (2006.01) |
| *D06F 37/26* | (2006.01) |

(52) U.S. Cl.

CPC ..... *D06F 37/28* (2013.01); *D06F 37/22* (2013.01); *D06F 39/14* (2013.01); *D06F 37/267* (2013.01); *D06F 39/12* (2013.01)

(58) Field of Classification Search

CPC ..... D06F 37/26; D06F 37/28; D06F 37/267; D06F 37/42; D06F 39/12; D06F 39/14

See application file for complete search history.

(56) References Cited

U.S. PATENT DOCUMENTS 5,398,528 A * 3/1995 Johnston ..... D06F 37/28 68/140
5,437,168 A * 8/1995 Mason ..... D06F 39/14 67/142
5,448,900 A * 9/1995 Cuthbert ..... D06F 37/10 68/139
5,469,593 A * 11/1995 Cuthbert ..... D06F 37/302 68/140

(Continued)

FOREIGN PATENT DOCUMENTS

GB 2360297 A * 9/2001 ..... D06F 39/14
JP 2006-280401 A 10/2006

(Continued)

*Primary Examiner* — Joseph L. Perrin
(74) *Attorney, Agent, or Firm* — Dentons US LLP

(57) ABSTRACT

A washing machine is disclosed. The washing machine includes a cabinet having a first introduction port, a tub, which is disposed in the cabinet and which has a second introduction port concentrically positioned with respect to the first introduction port, a cabinet door mounted on the cabinet so as to open and close the first introduction port, a tub door mounted on the tub so as to open and close the second introduction port, and a lock-releasing unit for releasing the locked state of the tub door when the cabinet door is opened.

14 Claims, 15 Drawing Sheets

(56) References Cited

U.S. PATENT DOCUMENTS

| | | | | |
|---|---|---|---|---|
| 5,546,772 | A * | 8/1996 | Merlin | D06F 37/10 68/142 |
| 6,233,981 | B1 * | 5/2001 | Grandpierre | D06F 37/10 68/140 |
| 7,013,682 | B2 * | 3/2006 | Sharrow | D06F 37/10 68/12.26 |
| 8,215,135 | B2 * | 7/2012 | Hapke | D06F 37/42 134/57 DL |
| 2008/0223086 | A1 * | 9/2008 | Zardetto | D06F 39/14 68/142 |
| 2011/0120195 | A1 * | 5/2011 | Jeoung | D06F 39/14 68/139 |

FOREIGN PATENT DOCUMENTS

| | | | |
|---|---|---|---|
| JP | 2010-51542 | A | 3/2010 |
| KR | 20-1995-0005184 | Y1 | 6/1995 |
| KR | 10-0452354 | B1 | 10/2004 |
| KR | 10-0534644 | B1 | 12/2005 |
| KR | 10-2007-0063998 | A | 6/2007 |
| KR | 10-2010-0070707 | A | 6/2010 |
| KR | 10-2010-0120046 | A | 11/2010 |
| KR | 10-2011-0057920 | A | 6/2011 |
| KR | 10-2012-0043263 | A | 5/2012 |

* cited by examiner

WASHING MACHINE

CROSS-REFERENCE TO RELATED APPLICATIONS

This application claims the benefit of Korean Patent Application Nos. 10-2015-0038752, filed on Mar. 20, 2015, and 10-2015-0038753, filed on Mar. 20, 2015, which are hereby incorporated by reference as if fully set forth herein.

BACKGROUND

Field of the Disclosure

The present invention relates to a washing machine, and more particularly to a washing machine, which is provided with a door having an improved structure to prevent or substantially reduce vibration and noise, generated in a tub, from being transmitted to a case while the washing machine is operating.

Discussion of the Conventional Art

Generally, a washing machine refers to an electrical household appliance that removes contaminants from laundry by employing the emulsification of detergent, rubbing action and impact action, which are applied to the laundry by water stream generated by the rotation of a pulsator or a drum, and the like.

A fully-automatic washing machine generally refers to a washing machine that automatically performs a series of courses composed of a washing course, a rinsing course, a dehydrating course and the like, without the need for intervening manipulation by a user.

A drum washing machine generally refers to a washing machine that has a reduced overall height compared to a pulsator washing machine; however, during operation, the laundry becomes entangled and a large number of wrinkles are generated.

The structure of a conventional drum washing machine 10, as described above, will be briefly described with reference to the accompanying drawing shown in FIG. 1. As shown in FIG. 1, the conventional washing machine 10 includes a cabinet 11, a tub 13, which is supported inside the cabinet 11 by a damper (not shown) and a spring (not shown) and which contains washing water, and a cylindrical drum 15, which is provided inside the tub 13 to hold laundry and which receives a driving force from the drive unit 17 for washing the laundry held in the drum 15. This washing machine 10 necessarily includes a gasket 19 between the opening of the tub 13 and the cabinet 11 to prevent washing water in the tub 13 from leaking.

When the drum 15 rotates to wash and dehydrate the laundry contained therein, the washing machine 10 generates vibrations attributable to the rotation of the drum 15, eccentric disposition of laundry or the like, and the vibrations generated by the rotation of the drum 15 are transmitted to the outside through the tub 13 and the cabinet 11.

The vibrations and noise transmitted to the tub 13 are transmitted to the cabinet 11 through the gasket 19, which maintains a watertight state between the cabinet 11 and the tub 13, which subjects the cabinet 11 to vibrations and noise.

Additionally, In the conventional washing machine 10, laundry may become caught between the door 12 for closing the tub 13 and the drum 15. To prevent laundry from being caught between the door and the drum, the door 12 is constructed such that the inner surface of the door 12 projects toward the inside of the opening of the tub 13 or the drum 15. However, the projecting structure of the door occupies part of the washing volume in the drum 15, thereby reducing the washing capacity of the washing machine 10.

SUMMARY OF THE DISCLOSURE

Accordingly, the invention relates to a washing machine that substantially obviates one or more problems due to limitations and disadvantages of the conventional art.

An object of the invention is to provide a washing machine with an improved structure between a tub and a cabinet to prevent vibration or noise, generated in the tub, from being transmitted to the cabinet through a gasket.

Another object of the invention is to provide a washing machine with an improved internal structure between a tub and a cabinet to increase the capacity of the tub as compared to a conventional washing machine.

Additional advantages, objects, and features of the invention are set forth in the description which follows and will become apparent to those having ordinary skill in the art upon examination of the following description or may be learned from practice of the invention.

To achieve these objects and other advantages and in accordance with the purpose of the invention, as embodied and broadly described herein, according to an embodiment of the invention, a washing machine includes a cabinet having a first introduction port; a tub, which is provided in the cabinet, the tub having a second introduction port that is positioned concentric with respect to the first introduction port; a cabinet door attached to the cabinet to open and close the first introduction port; a tub door attached to the tub to open and close the second introduction port; and a lock-releasing unit to unlock the tub door when the cabinet door is opened.

In another aspect of the present invention, a washing machine includes a cabinet having a first introduction port; a tub, which is provided in the cabinet, the tub having a second introduction port that is positioned concentric with respect to the first introduction port; a drum, which is rotatably disposed in the tub, the drum having a space to hold laundry introduced through the first and second introduction ports; a cabinet door attached to the cabinet to open and close the first introduction port; a tub door attached to the tub to open and close the second introduction port; a cabinet door lock provided at the cabinet to keep the cabinet door in a locked state; a tub door lock provided at the tub to keep the tub door in a locked state; and a lock-releasing unit to release the locked state of the tub door when the cabinet door is opened.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 7(*b*) is an exploded perspective view showing the cabinet door lock of the washing machine according to an embodiment of the invention;

DETAILED DESCRIPTION OF EXEMPLARY EMBODIMENTS

Hereinafter, a washing machine according to an embodiment of the invention is described in detail with reference to the accompanying drawings.

Reference will now be made in detail to the preferred embodiments of the invention, examples of which are illustrated in the accompanying drawings. Wherever possible, the same reference numbers will be used throughout the drawings to refer to the same or like parts.

Figure 1:
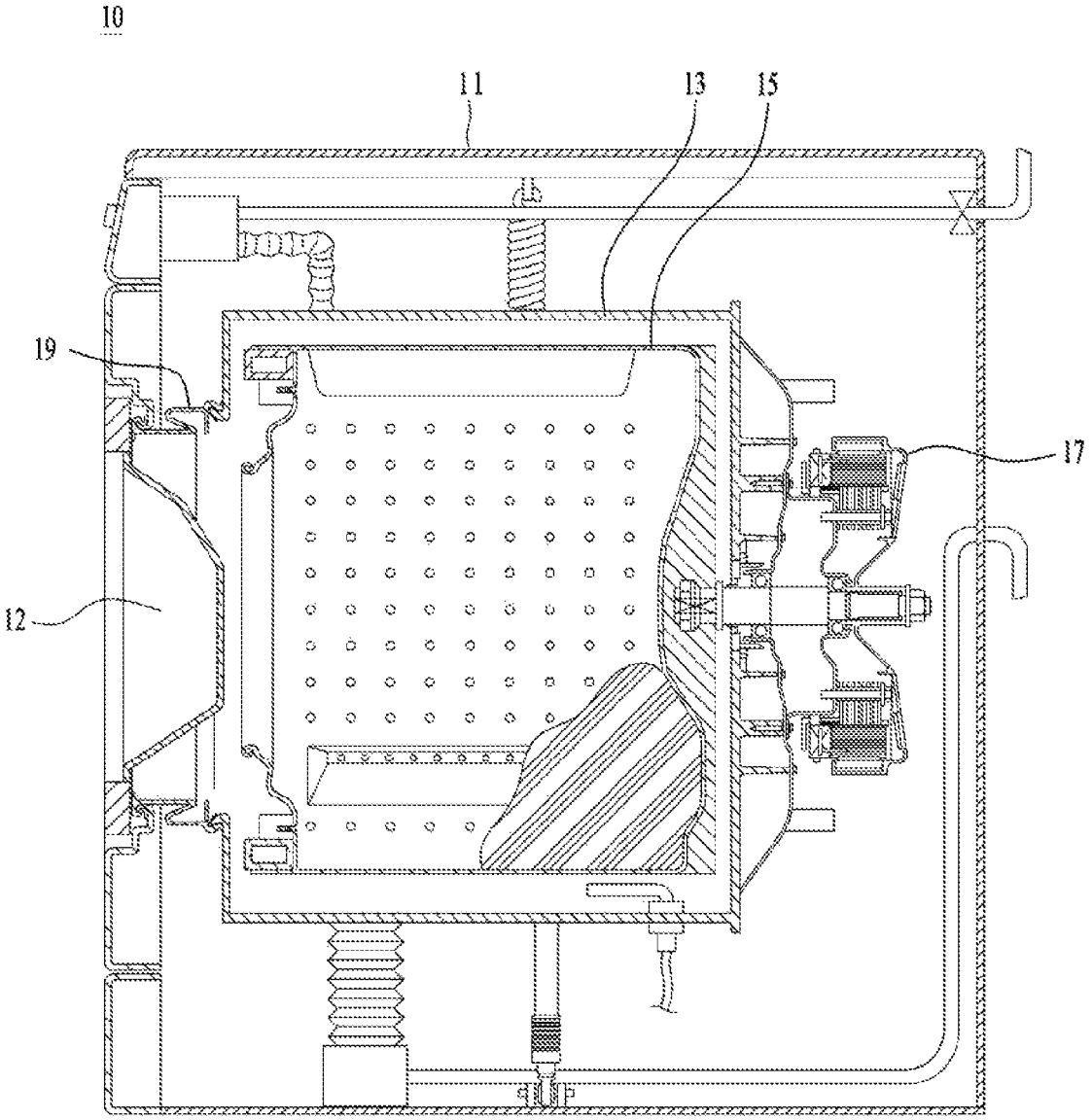
FIG. 1 a schematic view showing a conventional washing machine.
Figure 2:
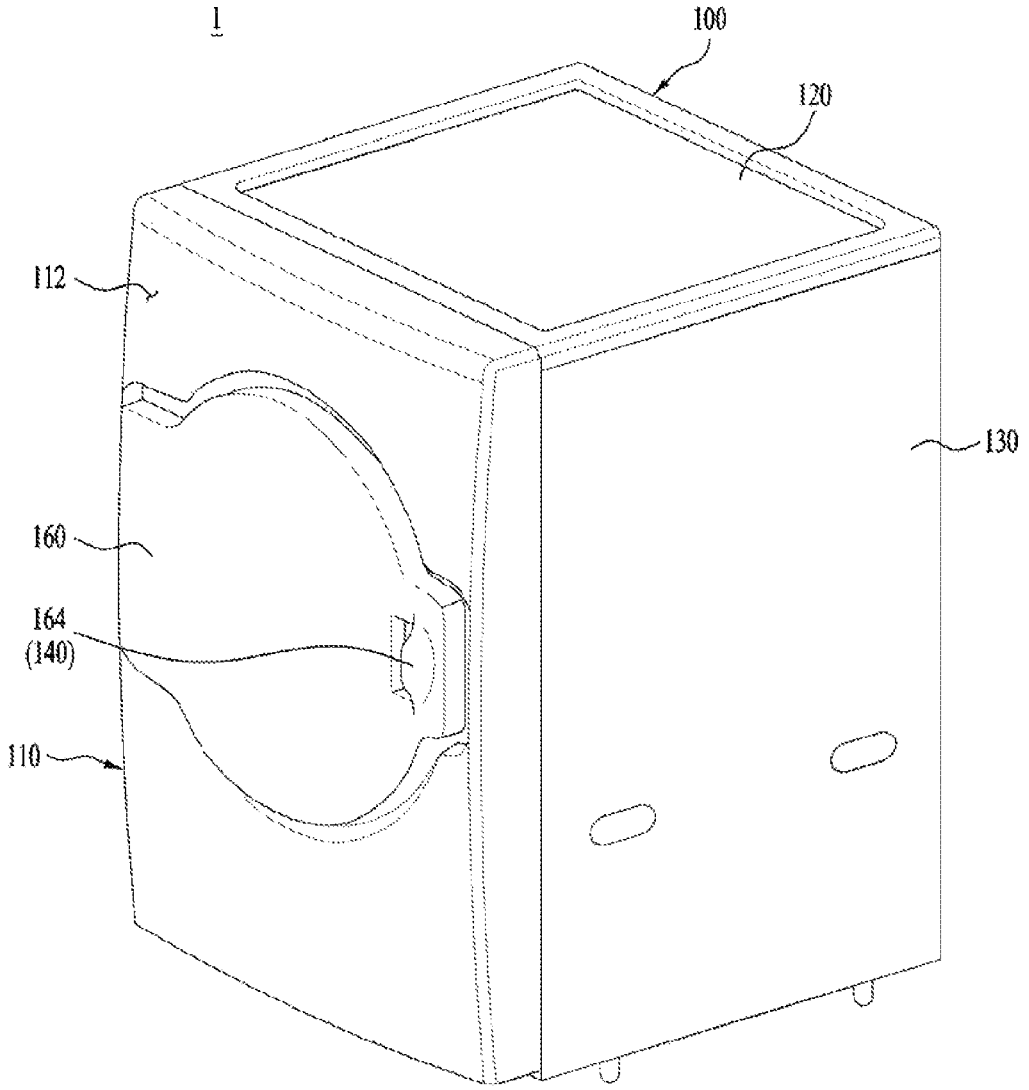
FIG. 2 is a perspective view showing a washing machine according to an embodiment of the invention.
Figure 3:
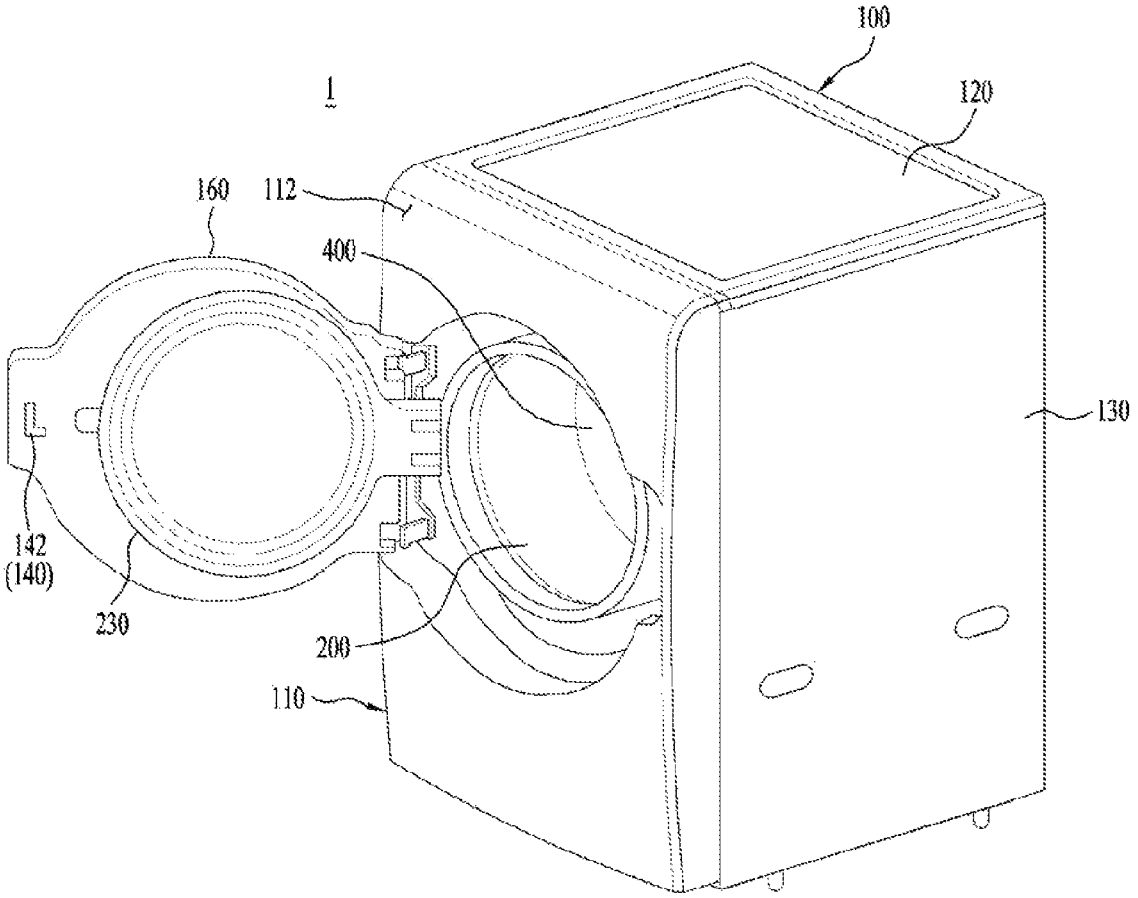
FIG. 3 is a perspective view showing the washing machine according to an embodiment of the invention, in which respective doors are opened.

FIG. 2 is a perspective view showing a washing machine according to an embodiment of the invention. FIG. 3 is a perspective view showing the washing machine according to an embodiment of the invention, in which respective doors are opened.

As shown in FIGS. 2 and 3, the washing machine 1 includes a cabinet 100, a tub 200, which is supported inside the cabinet 100 by a suspension component such as a damper and/or a spring and which holds washing water therein, a drum 400 that is rotatably disposed inside tub 200 to hold laundry therein, and a drive unit (not shown) to rotate drum 400.

Cabinet 100 may include a front cabinet part 110, right and left cabinet parts 130, and an upper cabinet part 120. Front cabinet part 110 includes a first introduction port 114 through which laundry is introduced into the containing space of drum 400. First introduction port 114 has a cabinet door 160 for opening and closing first introduction port 114.

Washing machine 1 may include a control panel 112, which may be provided over first introduction port 114. The control panel 112 may include a manipulation part and a display part for controlling and displaying the operation of washing machine 1.

Washing machine 1 is provided with a second introduction port 210 in the front of tub 200 to allow laundry, which has been introduced in first introduction port 114, to enter drum 400 therethrough. Second introduction port 210 is provided with a tub door 230 to open and close second introduction port 210.

Hereinafter, front cabinet part 110 and tub 200 are described in detail with reference to FIGS. 4 and 5.

Figure 4:
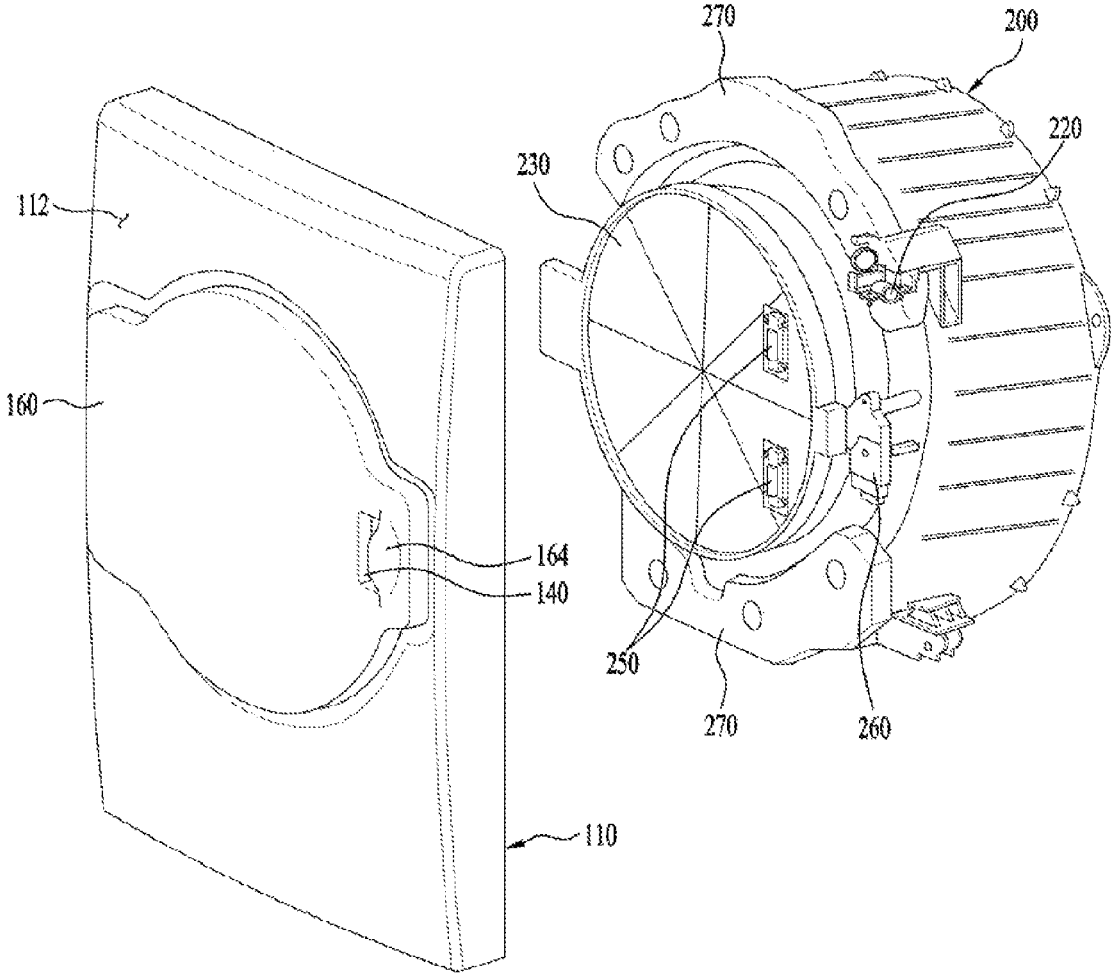
FIG. 4 is a perspective view showing an installation of the cabinet door and the tub door according to an embodiment of the invention.

FIG. 4 is a perspective view showing an installation of cabinet door 160 and tub door 230 according to an embodiment of the invention. FIG. 5 is an exploded perspective view showing the installation of cabinet door 160 and tub door 30 according to an embodiment of the invention.

Figure 5:
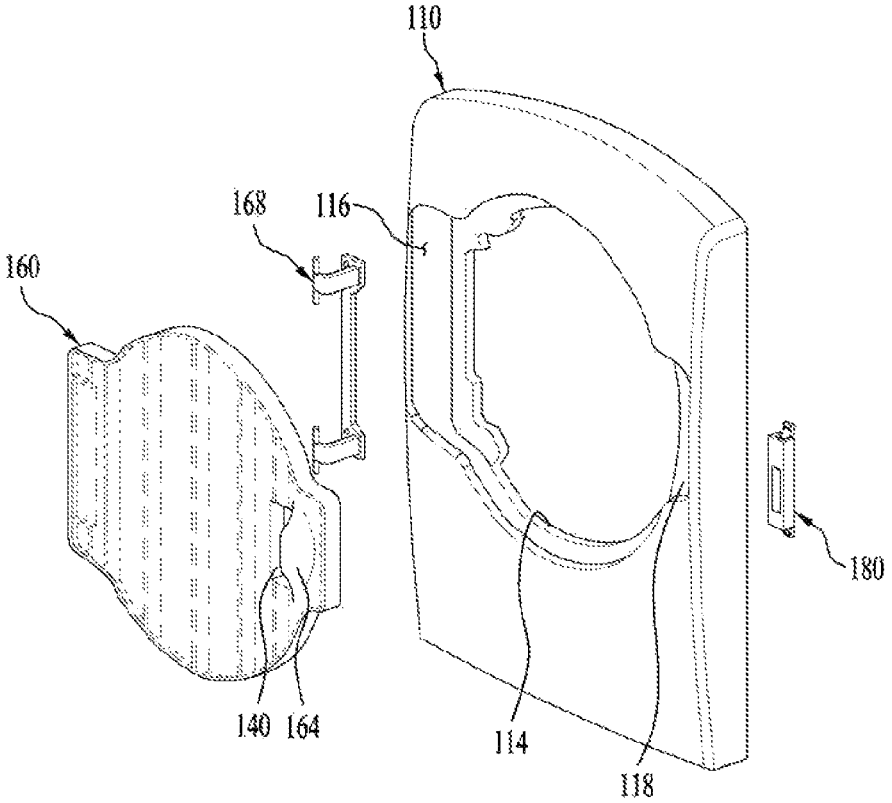
FIG. 5 is an exploded perspective view showing the installation of the cabinet door and the tub door according to an embodiment of the invention.

As shown in FIGS. 4 and 5, front cabinet part 110 includes a cabinet hinge mount 116, which is provided at a side of first introduction port 114 and to which cabinet door 160 is hingedly coupled. Front cabinet part 110 further includes a cabinet door lock mount 118, which is provided at another side of first introduction port 114, opposite cabinet hinge mount 116, so as to set the locked state of cabinet door 160.

Cabinet door lock 180 is mounted in cabinet door lock mount 118 so as not to be exposed to the outside of the cabinet 100 from front cabinet part 110. Cabinet door 160 is provided at the opposite side thereof with a handle 164 that functions to open cabinet door 160.

Handle 164 is provided therein with a lock-releasing unit 140 to lock and release cabinet door 160 and tub door 230. Lock-releasing unit 140 is functions to simultaneously release the locked state of cabinet door lock 180 and the locked state of tub door lock 260.

Figure 6:
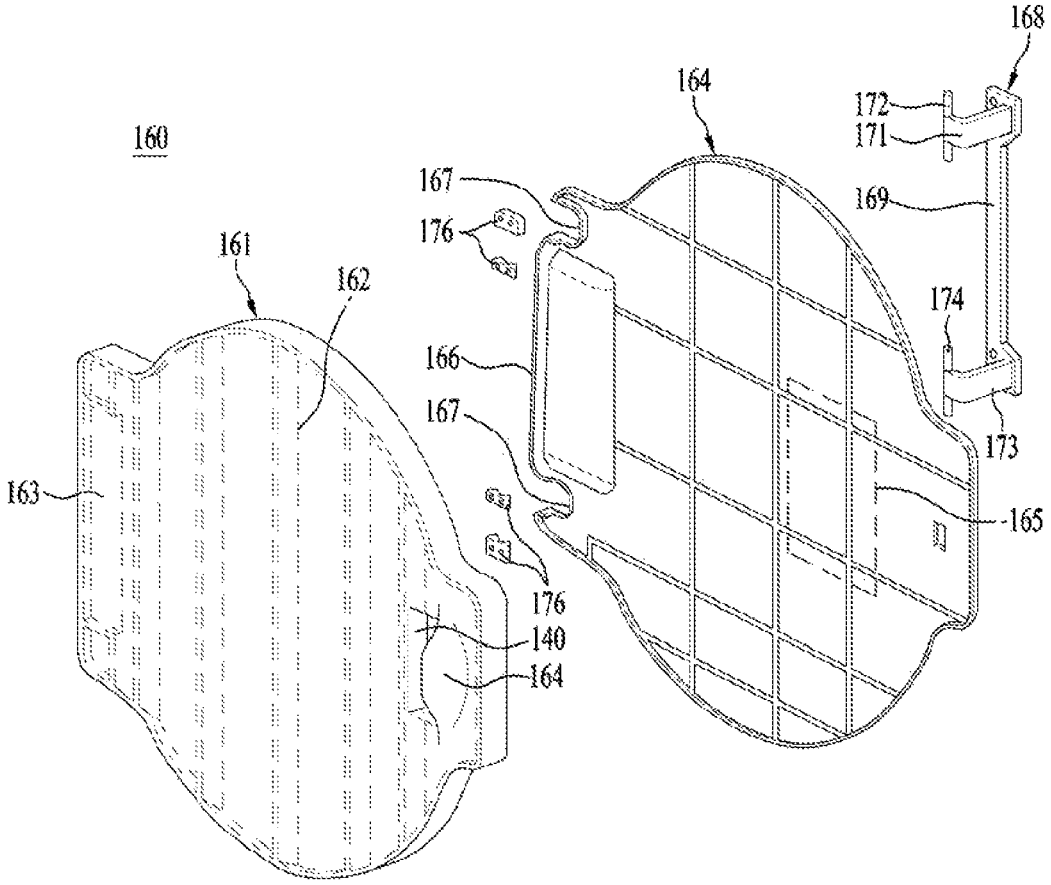
FIG. 6 is an exploded perspective view showing the cabinet door of the washing machine according to an embodiment of the invention.

As shown in FIG. 6, cabinet door 160 is hingedly provided at first introduction port 114 of front cabinet part 110 to open and close first introduction port 161. Cabinet door 160 may include a first outer frame 161 to define or delineate an outer face of cabinet door 160, a first inner frame 164 to define or delineate an inner face of cabinet door 160, and a first hinge unit 168 to hingedly support cabinet door 160.

First outer frame 161 and first inner frame 164 may be coupled together by fastening members (not shown) such as bolts, and may be made of a transparent material so that the internal operating condition is visible.

The outer surface of cabinet door 160, which is the outer surface of the first outer frame 161, is preferably flush with the surface of the front cabinet part 110, and is provided at a side thereof opposite the first hinge unit 168 with the handle 164.

The inner surface of first outer frame 161 may be provided with reinforcing ribs 162 to strengthen the first outer frame 161. The inner surface of cabinet door 160, which is the outer surface of first inner frame 164, is provided with a roller-contacting surface 165 with which push rollers 250 of tub door 230 come into contact.

When cabinet door 160 is pushed and closed by a user, roller-contacting surface 165 presses against push rollers 250 of tub door 230 to cause tub door 230 and cabinet door 160 to close together.

Cabinet door 160 is provided at one side thereof with first hinge unit 168, which is mounted on the cabinet hinge mount 116 provided at the periphery of first introduction port 114 to hingedly support cabinet door 160.

Handle 164 formed on the first outer frame is provided therein with lock-releasing unit 140, which engages with cabinet door lock 180 when the cabinet door 160 closes first introduction port 114 and releases the locked state of cabinet door lock 180 in response to manipulation by a user.

First outer frame 161 is provided with a projection 163 on which first hinge unit 168 is mounted, and first inner frame 168 is provided at an area corresponding to projection 163 of first outer frame 161 with a projection 166.

First inner frame 164 is provided above and below projection 166 with a pair of recesses 167, into which upper and lower hinge rods 171 and 173 of first hinge unit 168 are received. Recesses 167, which are provided above and below projection 166, are respectively provided with a pair of brackets 176 for rotatably supporting upper and lower rotating shafts 172 and 174 of first hinge unit 168.

Projection 166, recesses 167, and brackets 176, which are provided at first inner frame 168, are shielded from the outside by projection 163 provided on first outer frame 161 when first outer frame 161 is coupled to first inner frame 168.

First hinge unit 168 includes a hinge body 169, which is coupled to the cabinet hinge mount 116, which is provided at the periphery of first introduction port 114 of front cabinet part 110, upper hinge rod 171 and lower hinge rod 173, which respectively extend from upper and lower portions of hinge body 169, and upper hinge shaft 172 and lower hinge shaft 174, which respectively extend from upper hinge rod 171 and lower hinge rod 173.

Upper and lower hinge rods 171 and 173, which are provided at hinge body 169 of first hinge unit 168, are preferably spaced apart from each other by a predetermined spacing. In order to prevent upper and lower hinge rods 171 and 173 from interfering with a second hinge unit 242 of tub door 230, upper and lower hinge rods 171 and 173 are spaced apart from each other by a predetermined spacing such that second hinge unit 242 is positioned between upper and lower hinge rods 171 and 173.

Cabinet door lock mount 118, which is provided at the periphery of first introduction port 114 opposite cabinet hinge mount 116, is provided with cabinet door lock 180, to which a cabinet door hook 142 of lock-releasing unit 140, which has been inserted into front cabinet part 110, is locked.

Hereinafter, lock-releasing unit 140 and cabinet door lock 180 according to an embodiment of the invention are described in detail with reference to FIGS. 7A and 7B.

FIG. 7(*a*) is a cross-sectional view showing lock-releasing unit 140 of the washing machine 1 according to an embodiment of the invention. FIG. 7(*b*) is an exploded perspective view showing the cabinet door lock 180 of the washing machine 1 according to an embodiment of the invention.

As shown in FIG. 7(*a*), lock-releasing unit 140 is positioned in handle 164 to release the locked state of cabinet door lock 180 when a user grasps the handle 164 to open cabinet door 142.

Lock-releasing unit 140 may include a release lever 141 for releasing the locked state of cabinet door lock 180, cabinet door hook 142, which is locked on cabinet door lock 180 when first introduction port 114 of cabinet door 160 is closed and which is released from cabinet door lock 180 when release lever 141 is pushed, and a torsional spring 143 to elastically bias cabinet door hook 142 to cause cabinet door hook 142 to be locked on cabinet door lock 180.

Figure 7A:
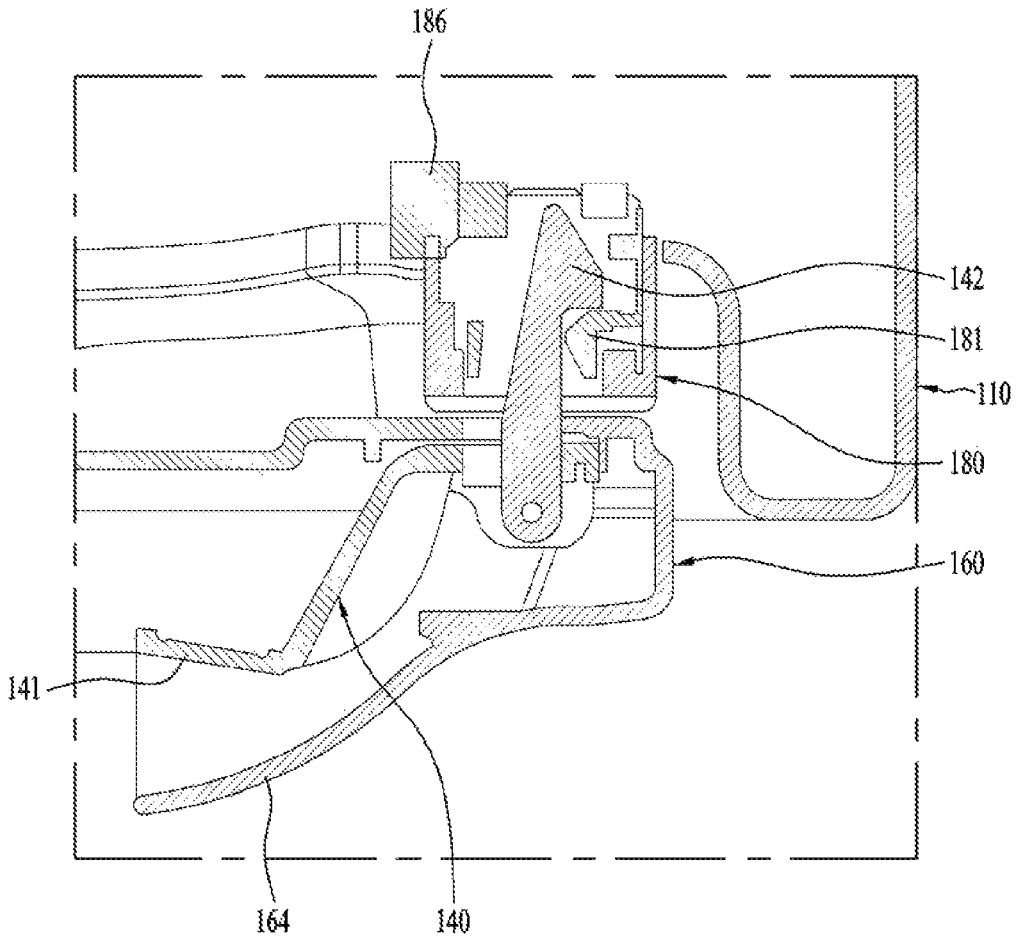
FIG. 7(*a*) is a cross-sectional view showing the lock-releasing unit of the washing machine according to an embodiment of the invention.
Figure 7B:
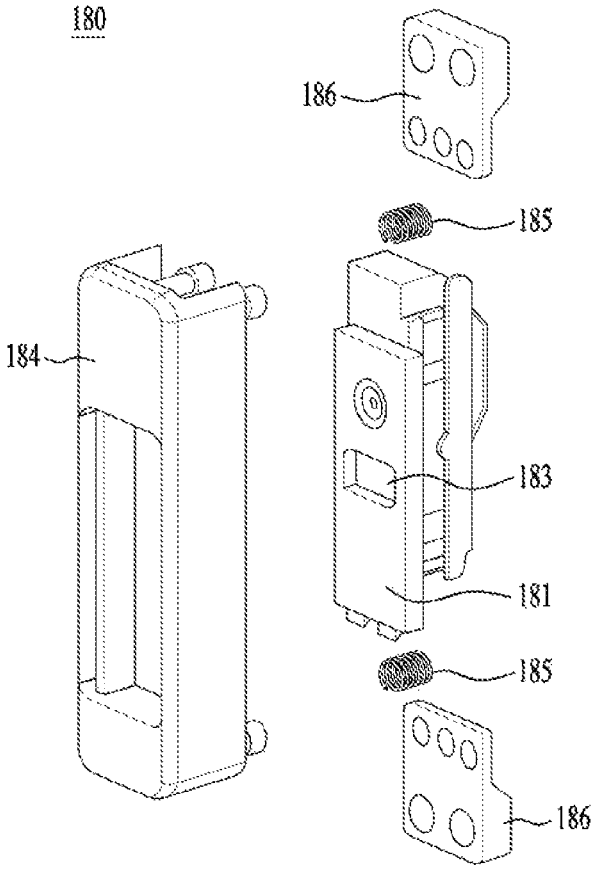

As shown in FIGS. 7A and 7B, cabinet door lock 180 controls the locked state of cabinet door 160 provided at first introduction port 114. Cabinet door lock 180 includes a hook-engaging portion 181, which is provided in cabinet door lock mount 118 of front cabinet part 110, a hook insert portion 183, which is provided outside cabinet door lock mount 118 and is coupled to hook-engaging portion 181 in a manner of being movable in the direction in which cabinet door hook 142 is inserted, an elastic support 184 to elastically support the hook insert portion 183 in the direction opposite to the direction of insertion of cabinet door hook 142 by an elastic component such as a spring, and a lock release switch 186 to detect the action of cabinet door hook 142 when in the locked state, in which cabinet door hook 142 engages with hook-engaging portion 181, is released. Lock release switch 186 generates an electrical signal to actuate a tub door lock releaser 220, as described below.

Cabinet door lock 180 further includes an allowance space to allow hook insert portion 183 to be elastically supported by elastic support 184 after cabinet door hook 142 engages with hook-engaging portion 181 while cabinet door 160 closes.

Accordingly, after cabinet door 160 is pushed and locked on hook-engaging portion 181 of cabinet door lock 180, cabinet door 160 may be further pushed so as to cause tub door 230 to be closed. The structure for the simultaneous operation of cabinet door 160 and tub door 230 will be described in detail below.

Hereinafter, tub door 230 is described in detail with reference to FIGS. 8 and 9.

Figure 8:
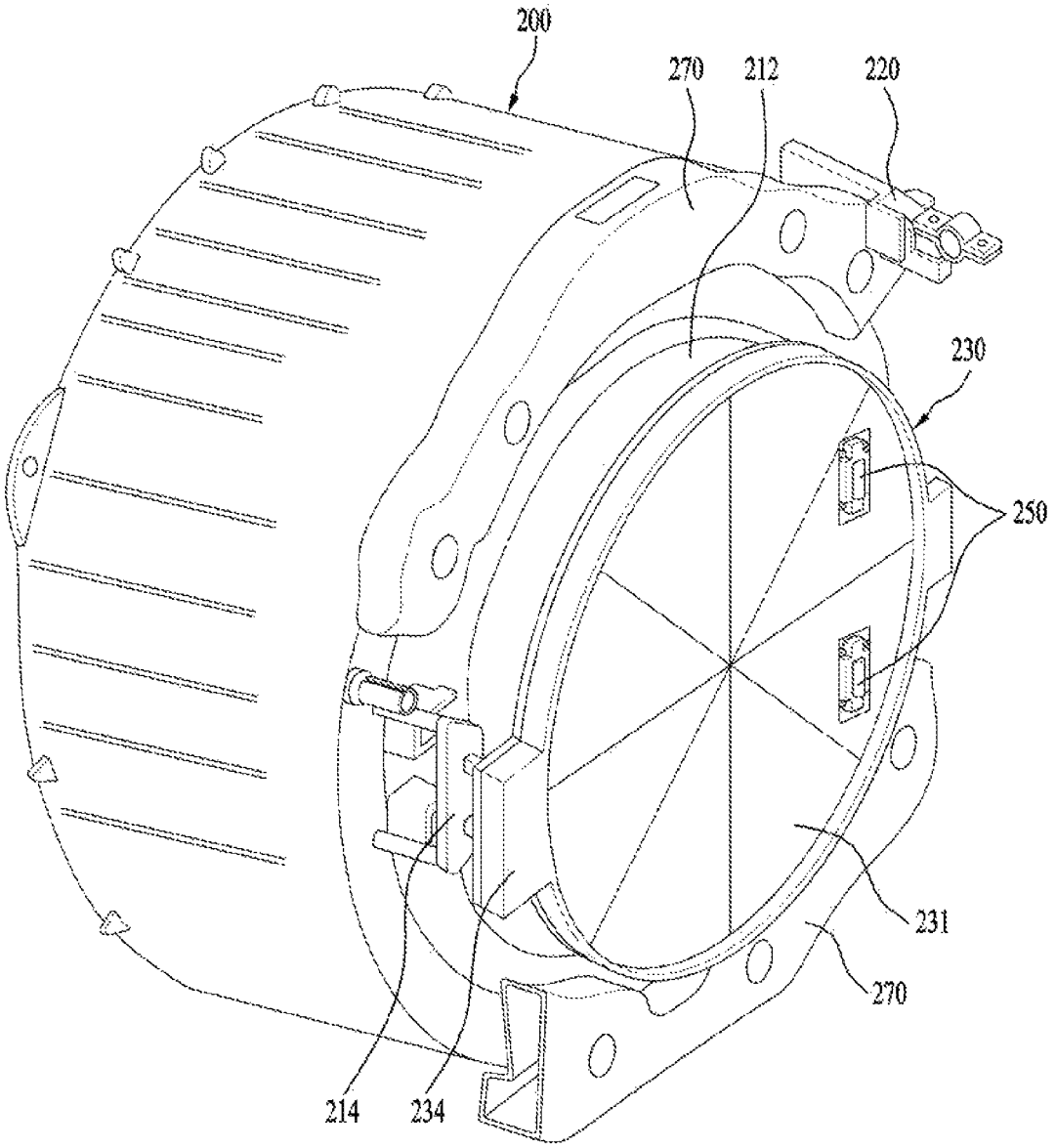
FIG. 8 is a perspective view showing the tub and the tub door of the washing machine according to an embodiment of the invention.

FIG. 8 is a perspective view showing tub 200 and tub door 230 of washing machine 1 according to an embodiment of the invention. FIG. 9 is an exploded perspective view showing the tub door 230 according to an embodiment of the invention.

Figure 9:
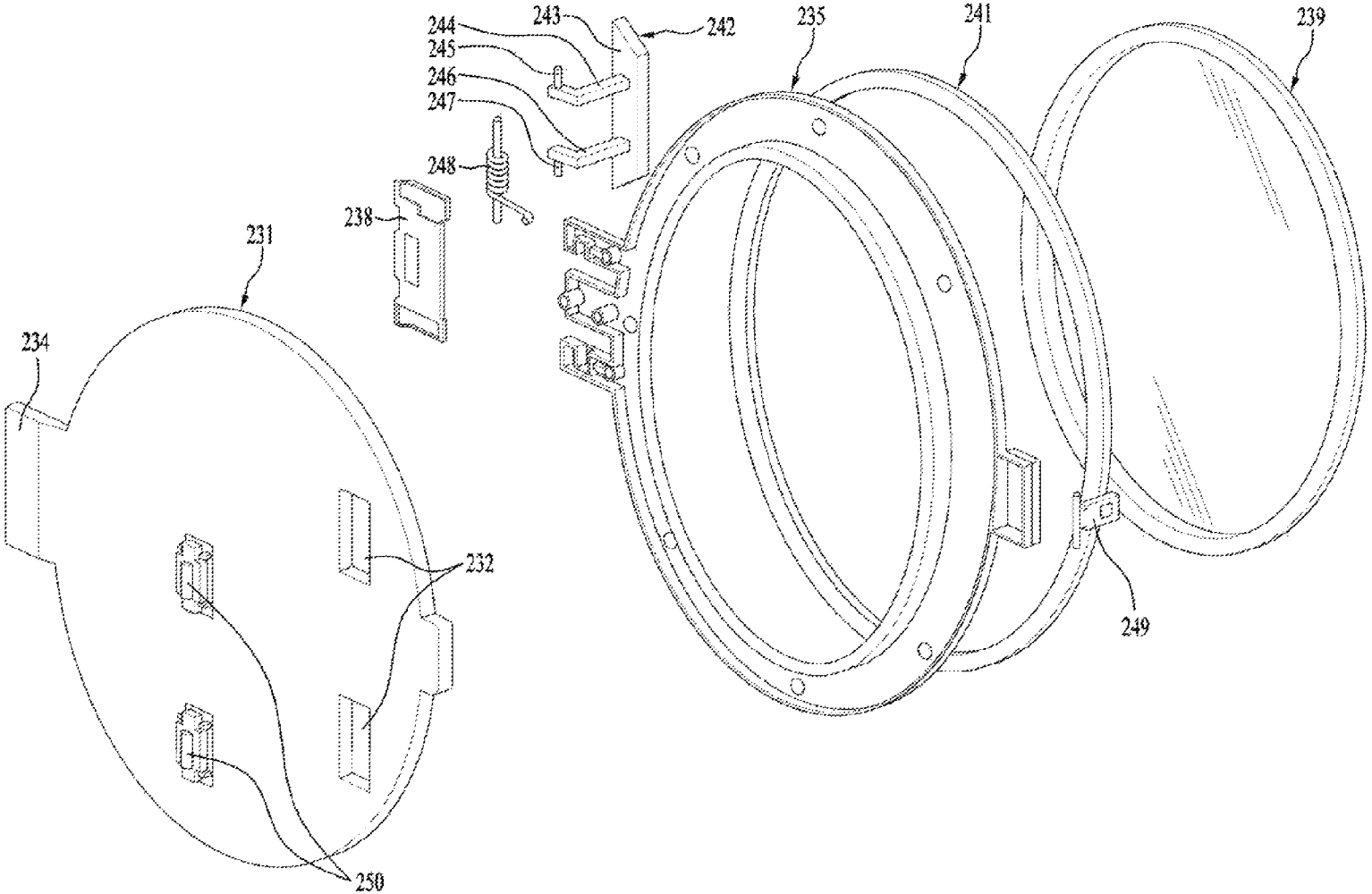
FIG. 9 is an exploded perspective view showing the tub door of the washing machine according to an embodiment of the invention.
Figure 10:
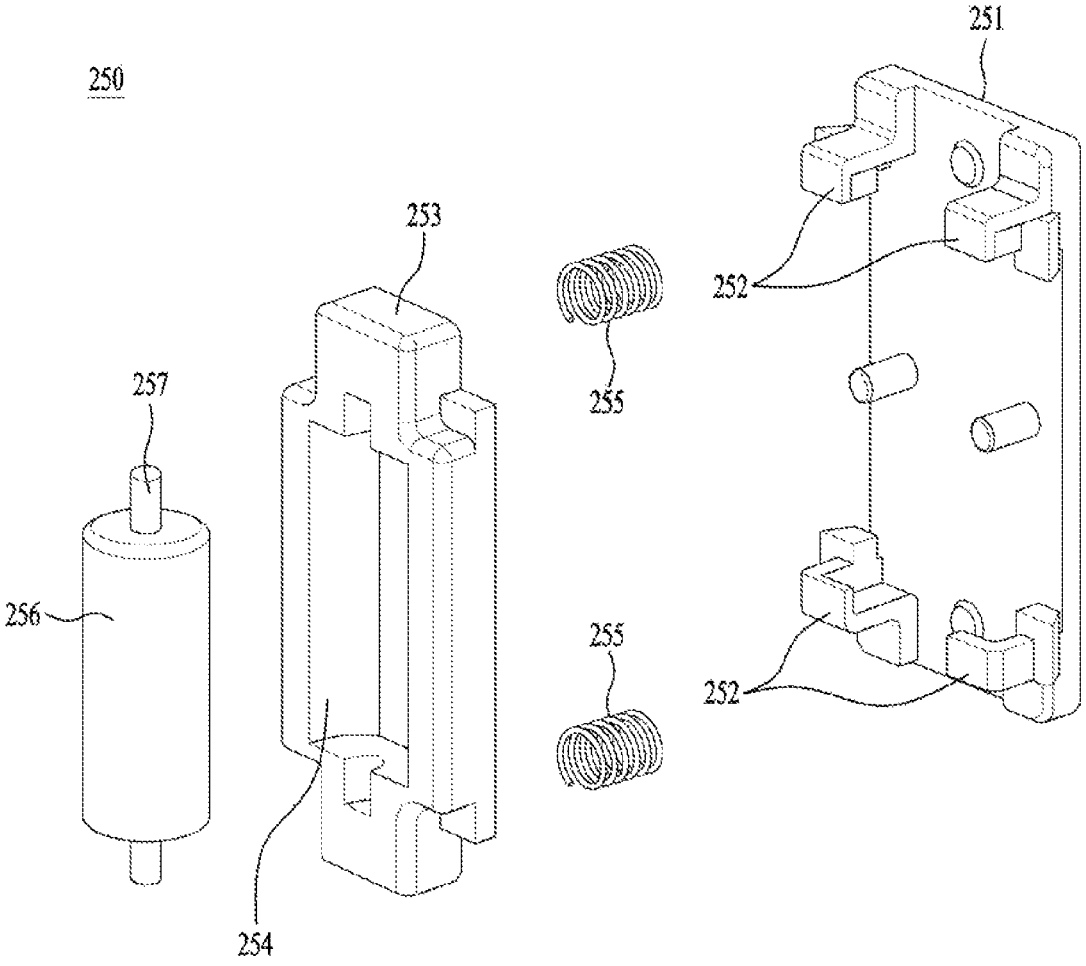
FIG. 10 is an exploded perspective view showing a push roller of the tub door of the washing machine according to an embodiment of the invention.

As shown in FIGS. 8 and 9, tub 200 is provided in the front thereof with second introduction port 210 for the insertion of laundry, second introduction port 210 being separated from first introduction port 114 of cabinet 100 and is concentrically positioned with respect to first introduction port 114. Tub 200 is provided with weight balancers 270, which are disposed radially outside second introduction port 210 to increase the mass of tub 200 to prevent or substantially reduce the vibrations of tub 200. Tub 20 is provided at the periphery of second introduction port 210 with tub door 230 for opening and closing second introduction port 210 of tub 200, which is separate from cabinet 100.

Second introduction port 210, which is disposed at the front of tub 200, includes an annular rim 212, which protrudes toward front cabinet part 110. Rim 212 is provided at one lateral side thereof with a second hinge mount 214 on which second hinge unit 242 is mounted, and is provided at the other lateral side thereof with a tub door lock mount 216 on which tub door lock 260, for controlling the locked state of tub door 230, which is adapted to open and close second introduction port 210, is mounted.

Tub 200 is provided at one lateral side in the front thereof with second hinge unit 242, which rotatably supports tub door 230 and enables tub door 230 to open and close second introduction port 210, and is provided at the other lateral side in the front thereof with tub door lock 260 for controlling the locked state of tub door 230. Tub 200 is further provided over tub door lock 260 with tub door lock releaser 220 for releasing the locked state of the tub door lock 260.

Tub door 230, tub door lock 260, and tub door lock releaser 220 are connected to cabinet 100, and tub 200 is supported by the suspension (not shown), independent of cabinet 100.

Unlike the conventional washing machine 1, since only the suspension is disposed between tub 200 and cabinet 100, without gasket 9, and vibrations of tub 200 are transmitted only to the suspension, it is possible to substantially reduce the transmission of vibration from tub 200 to cabinet 100.

Tub door 230 includes a second outer frame 231, which generally defines or delineates an outer face of tub door 230, an annular second inner frame 235, which generally defines or delineates an outer surface of the tub door 230 and has a hole in the center thereof, an annular ring sealer 241, which is disposed between second outer frame 231 and second inner frame 235 to ensure a seal between second introduction port 210 of tub 200 and tub door 230, and a transparent frame 239, which is fitted in the hole in the center of second inner frame 235 so that the interior of tub 200 or the drum 400 is visible.

Second inner frame 235 is provided at a lateral side thereof with a projection 236 to which second hinge unit 242 is coupled. Projection 236 includes recesses 237 in which upper and lower hinge rods 244 and 246 and a hinge spring 248 of second hinge unit 242 are received. Second inner frame 235 is provided at the other lateral side, opposite second hinge unit 242, and includes a tub door hook 249, which is fitted into the door lock 260 to maintain the locked state of tub door 230.

Second outer frame 231 is provided at a lateral side thereof with a projection 234 to cover the projection 236 that is provided at second inner frame 235, and is provided at predetermined areas on the outer surface thereof with push rollers 250. The push rollers 250 contact the roller-contacting surface 165 of cabinet door 160 disposed outside tub door 230 and push cabinet door 160 outward when tub door 230 is rotated in the opening direction.

Push rollers 250 also prevent cabinet door 160 or tub door 230 from being damaged due to friction between cabinet door 160 and tub door 230 when tub door 230 is opened by hinge spring 248 of second hinge unit 242.

Figure 11:
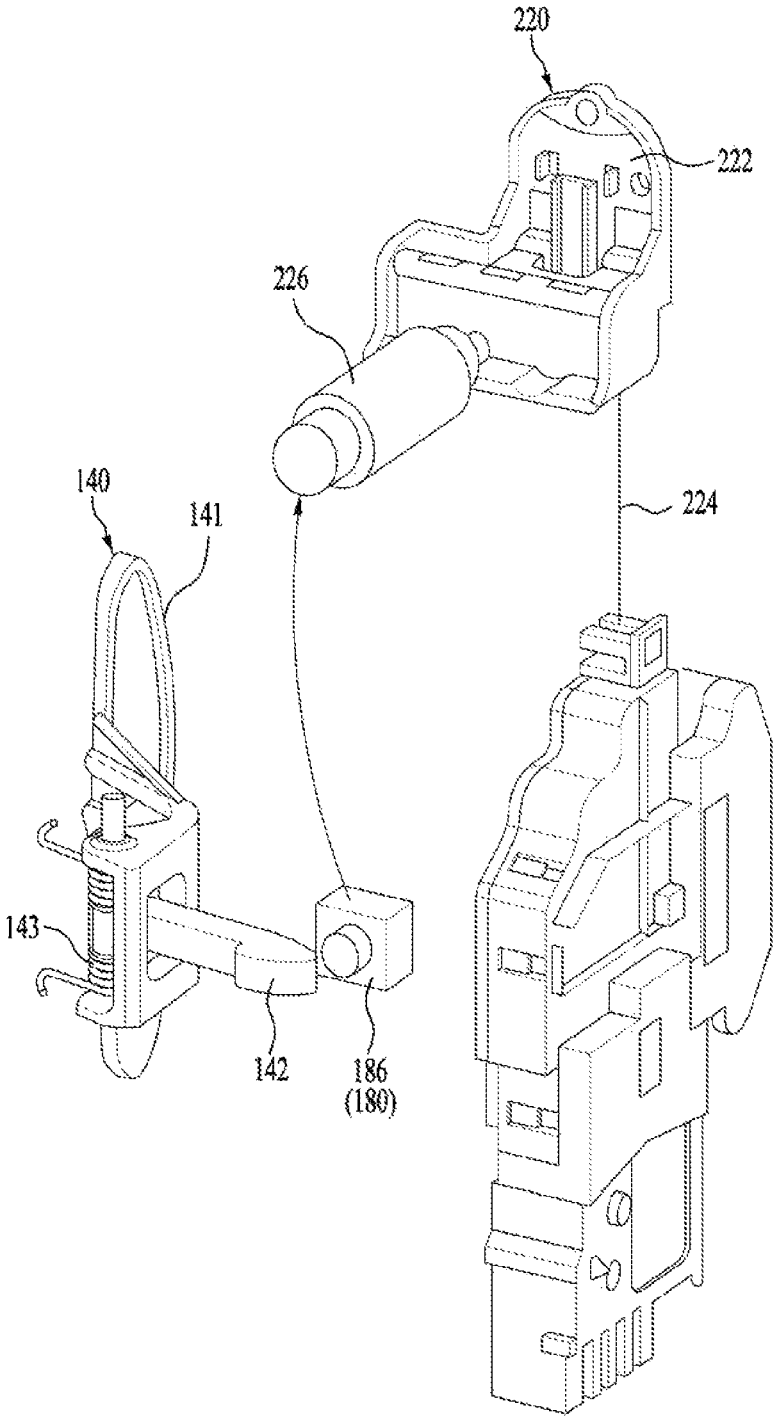
FIG. 11 is a conceptual view showing a lock-releasing unit of the washing machine according to an embodiment of the invention.

As shown in FIG. 11, each of push rollers 250 includes a mounting base 251 fitted in a roller fitting portion 232 formed in second outer frame 231 of tub door 230, a movable member 253, which is movably coupled to mounting base 251 with a predetermined spacing therebetween, and a roller 256, which is provided in movable member 253 and has a rotating shaft 257 parallel to the rotating shafts of cabinet door 160 and tub door 230.

Mounting base 251 is provided at respective corners thereof with protrusions 252 for limiting the distance that movable member 253 can move. Since movable member 253 interferes with protrusions 252 of mounting base 251, separation of movable member 253 from mounting base 251 is prevented.

Springs 255 are disposed between mounting base 251 and movable member 253 so that movable unit 253 is spaced apart from mounting base 251 by a predetermined elastic force. Movable member 253 has a roller hole 254 in which roller 256 is rotatably mounted.

Accordingly, when tub door 230 opens, push rollers 250 contact with roller-contacting surface 165 formed on first inner frame 164 of cabinet door 160 and push out cabinet door 160 in the opening direction, thereby opening cabinet door 160.

Meanwhile, second hinge unit 242 is mounted on second hinge mount 214, which is provided at a lateral side of rim 212 of second introduction port 210, to rotatably support tub door 230 and to provide an elastic force to bias tub door 230 in the direction in which second introduction port 210 is opened.

Second hinge unit 242 includes a hinge body 243 mounted on second hinge mount 214, upper and lower hinge rods 244 and 246, extending from upper and lower portions of hinge body 243, upper and lower hinge shafts 245 and 247, which are respectively provided at the ends of upper and lower hinge rods 244 and 246 and are rotatably received in recesses 237 in second inner frame 235, and hinge spring 248, which has the same rotating axis as the upper and lower rotating shafts 245 and 247 and provides the tub door 230 with elastic force to bias tub door 230 in the direction in which tub door 230 is opened with respect to second introduction port 210.

Upper and lower hinge rods 244 and 246 of second hinge unit 242 are preferably configured to have therebetween a smaller spacing than the spacing between upper and lower hinge rods 171 and 173 of first hinge unit 168. First hinge unit 168 and second hinge unit 242 rotatably support cabinet door 160 and tub door 230 about different rotating shafts. Accordingly, to prevent the rotating shafts of first and second hinge units 168 and 242 from interfering with each other, the axes of the rotating shafts of first and second hinge units 168 and 242 are separated from and spaced apart from each other.

Tub door lock mount 216, which is provided at the other lateral side of second introduction port 210 of tub 200, is provided with tub door lock 260, on which tub door hook 249 of tub door 230 is fitted and locked. Tub door lock 216 is provided with tub door lock releaser 220, which releases the locked state of tub door lock 260 in response to an actuation of lock-releasing unit 140.

Tub door lock releaser 220, which is intended to release the locked state of tube door lock 260 in response to a lock releasing signal generated by lock release switch 186 of lock-releasing unit 140, includes a solenoid 226, which actuates in response to a signal generated by lock release switch 186, a rotator 222, which is rotated by the actuation of solenoid 226, and a tensile cable 224 that transmits the rotational force of rotator 222 to tub door lock 260.

Tub door lock 260, which controls the locked state of the tub door 230 and is mounted on second introduction port 210, includes hook-engaging portion 181, mounted on tub door lock mount 216 proximate to second introduction port 210, and a cable connector 261, connected to tensile cable 224 of the tub door lock releaser 220 proximate to the hook-engaging portion 181.

It is understood that although tub door lock releaser 220 and tub door lock 230 are described separately in the above description, solenoid 226 of tub door lock releaser 220 may be provided directly on tub door lock 260 to release the locked state of tub door lock 260 in response to a signal from lock release switch 186 of cabinet door lock 180.

Hereinafter, the operation of the a washing machine 1 according to an embodiment of the invention is described in detail with reference to the accompanying drawings. The components discussed below should be understood in light of the above description and the accompanying drawings.

According to an embodiment of the invention, cabinet door hook 175 of cabinet door 160 is locked on cabinet door lock 180, and the locked state is maintained. Meanwhile, tub door hook 249 of tub door 230 is locked on tub door lock 260, and the locked state is maintained.

The operation of opening cabinet door 160 and tub door 230 is described with reference to the accompanying drawings.

Figure 12:
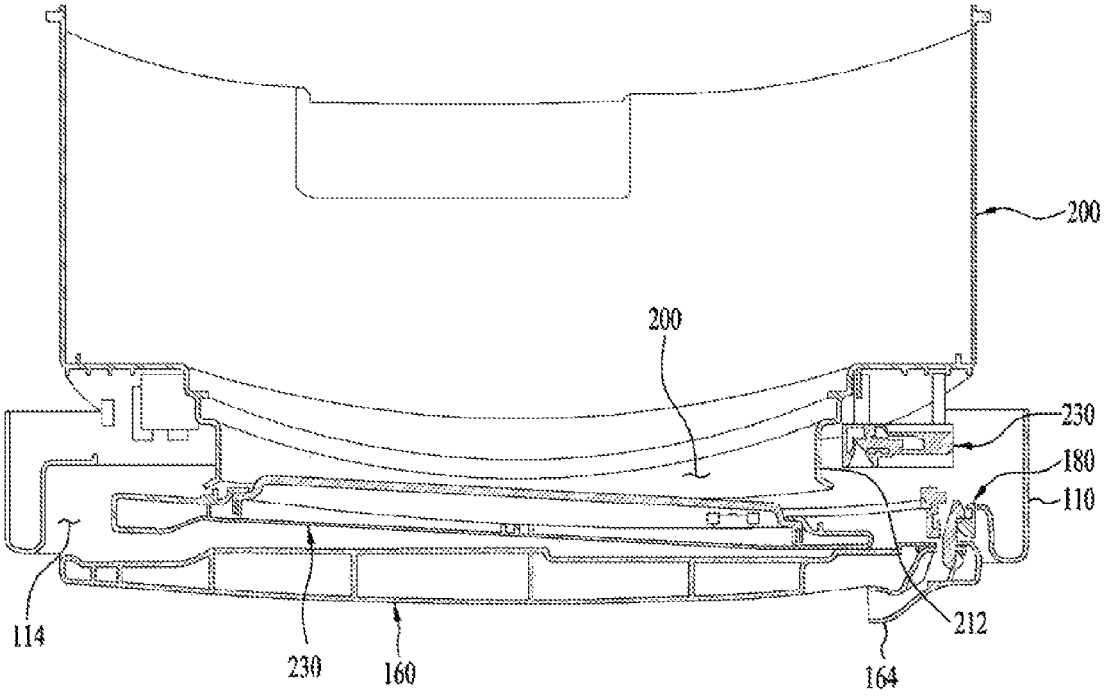
FIGS. 12 and 13 are plan cross-sectional views showing the locking unit of the washing machine according to an embodiment of the invention.
Figure 13:
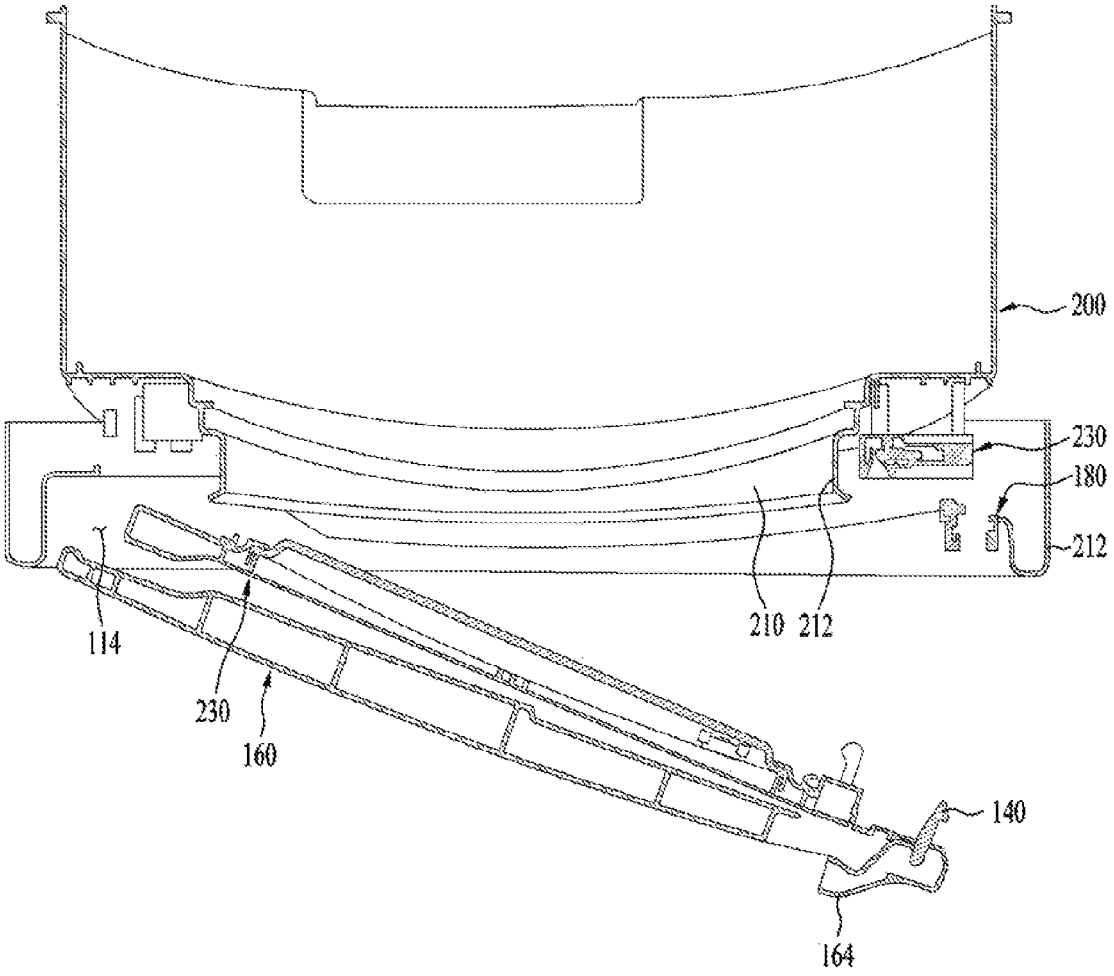

FIG. 11 is a conceptual view showing the lock-releasing 140 unit of the washing machine 1 according to an embodiment of the present invention. FIGS. 12 and 13 are plan cross-sectional views showing the locking unit of washing machine according 1 to an embodiment of the invention.

In order for a user to open cabinet door 160 of washing machine 1, the user grasps or manipulates handle 164, provided on cabinet door 160 of front cabinet part 110, in a direction in which cabinet door 160 is opened. Consequently, release lever 141 of lock-releasing unit 140, which is provided in handle 164, is rotated, thereby releasing the locked state of cabinet door hook 142. At this time, the release of the locked state of cabinet door hook 142 is detected by lock release switch 186 of cabinet door lock 180.

As a result, solenoid 226 of cabinet door lock releaser 150 is activated by the detection of lock release switch 186, thereby rotating rotator 222. As rotator 222 is rotated, cable connector 261 of tub door lock 260, which is connected to tensile cable 224, is actuated. Consequently, the locked state of tub door hook 249 is released, and the locked state of cabinet door 160 and the locked state of tub door 230 are released simultaneously.

By the release of the locked state of cabinet door 160 and tub door 230, tub door 230 is rotated in the opening direction by hinge spring 248 provided in second hinge unit 242 of tub door 230, and push rollers 250, which are provided on second outer frame 231 of tub door 230, push roller-contacting surface 165 that is provided on first inner frame 168 of cabinet door 160 to open cabinet door 160, thereby simultaneously opening tub door 230 and cabinet door 160.

Figure 14A:
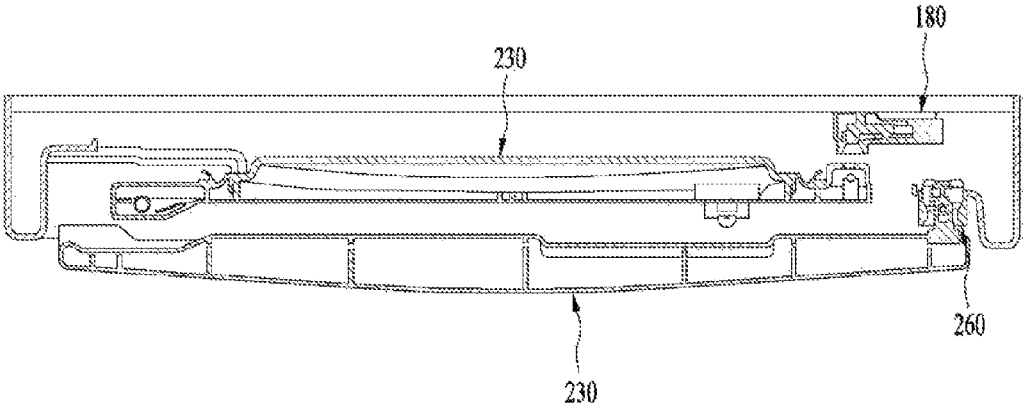
FIGS. 14(*a*), 14(*b*), and 14(*c*) are each a plan cross-sectional view that together show a locking operation of the washing machine according to an embodiment of the invention.
Figure 14B:
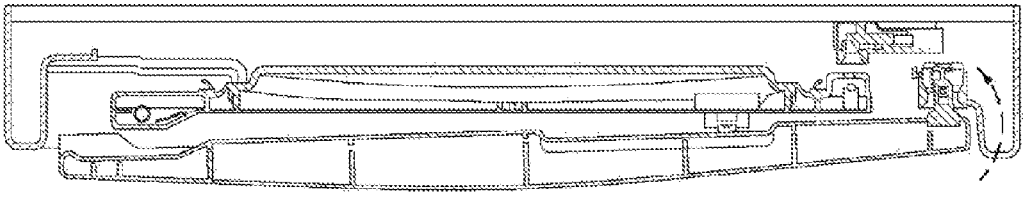
Figure 14C:
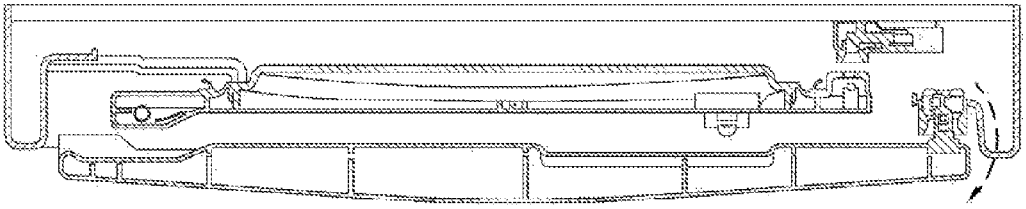

Hereinafter, the operation of closing cabinet door 160 and tub door 230 is described in detail according to an embodiment of the invention with reference to the accompanying drawings. FIG. 14 is a plan cross-sectional view sequentially showing the operation of locking the washing machine according to an embodiment of the invention.

During an operation of closing cabinet door 160 and tub door 230, as the user rotates cabinet door 160 in the closing direction, roller-contacting surface 165 provided on first inner frame 168 of cabinet door 160 make contact with push rollers 250 provided on second outer frame 231 of tub door 230, and cabinet door 160 and tub door 230 are thus rotated against an elastic force of hinge spring 248 that is provided in second hinge unit 242 of tub door 230.

Referring FIG. 14(*a*), as cabinet door 160 and tub door 230 are rotated, cabinet door hook 142 of cabinet door 160 is inserted into cabinet door lock 180, and, simultaneously, tub door hook 249 of tub door 230 is inserted into tub door lock 260.

Referring to FIG. 14(*b*), when cabinet door hook 142 of cabinet door 160 is inserted into cabinet door lock 180 by the rotation of cabinet door 160, cabinet door hook 142 engages with cabinet door lock 180 as a result of pressure caused by the rotation of cabinet door 160. This occurs because hook insert portion 183, into which cabinet door hook 142 is inserted, is elastically supported by the springs. At this time, tub door 230 moves a distance corresponding to the distance that hook insert portion 183 of cabinet door lock 180 moves, and then engages with tub door lock 260.

Referring to FIG. 14(*c*), when the pressure applied to cabinet door 160 by the user is released, hook insert portion 183 of cabinet door lock 180 is restored to the normal position by the elastic force of the springs supporting hook insert portion 183, and cabinet door 160, engaging with cabinet door lock 180, is restored to the position spaced apart from tub door 230 by the restoring force of hook insert portion 183, thereby completing the operation of closing cabinet door 160 and tub door 230.

Accordingly, because cabinet door 160 and tub door 230 are spaced apart from each other when they are closed, the direct transmission of vibrations from tub 200 to cabinet 100 during the washing operation is prevented.

As is apparent from the above description, according to an embodiment of the invention, the transmission of vibrations and noise from the tub to the cabinet is prevented by improving the structure between the tub and the cabinet, and vibrations and noise generated by the cabinet are thus reduced. Therefore, unpleasant vibrations and noise are prevented.

Furthermore, according to an embodiment of the invention, the improved structure between the tub 200 and the cabinet 100 increases the capacity of the tub 200.

It will be apparent to those skilled in the art that various modifications and variations can be made to the embodiments of the invention discussed herein without departing from the spirit or scope of the inventions. Thus, it is intended that the embodiments of the invention cover the modifications and variations of this invention provided they come within the scope of the appended claims and their equivalents.

What is claimed is:

1. A washing machine comprising:

a cabinet including a front cabinet part having a first introduction port formed at a front side thereof;

a tub provided in the cabinet, and having a second introduction port that is a concentric position with respect to the first introduction port;

a cabinet door attached to the cabinet to rotate forward to open and close the first introduction port;

a cabinet door lock provided on the front cabinet part to set a lock state of the cabinet door;

a tub door attached to the tub to rotate in a direction parallel to a rotation direction of the cabinet door to open and close the second introduction port;

a tub door lock provided at a front side of the tub to set a lock state of the tub door;

a lock-releasing unit provided on the cabinet door to unlock the cabinet door lock; and a tub door lock releaser provided in the cabinet to unlock the tub door by the tub door lock as the cabinet door is opened by the lock-releasing unit.

2. The washing machine of claim 1, wherein the cabinet door comprises a first hinge unit, and the tub door comprises a second hinge unit having a second hinge unit rotating shaft that is spaced apart from a first hinge unit rotating shaft of the first hinge unit.

3. The washing machine of claim 1, wherein the tub door is elastically biased in an opening direction of the second introduction port.

4. The washing machine of claim 3, wherein the tub door is opened in conjunction with the cabinet door when the cabinet door is opened.

5. The washing machine of claim 1, wherein the tub door is closed in conjunction with the cabinet door when the cabinet door is closed.

6. The washing machine of claim 1, wherein the cabinet door lock comprises:

a hook-engaging portion provided in a front cabinet part of the cabinet;

a hook insert portion coupled to the hook-engaging portion in a manner of being movable in the direction in which cabinet door is closed, an elastic support to elastically support the hook insert portion in the direction opposite to the direction of close of cabinet door.

7. The washing machine of claim 6, wherein the lock-releasing unit comprises:

a release lever provided at a handle of the cabinet door; and a lock release switch to detect when the cabinet door is opened in response to an actuation of the release lever.

8. The washing machine of claim 1, wherein the tub door is hingedly attached to the tub, and the tub includes a hinge unit to exert an elastic force in an opening direction of the second introduction port.

9. The washing machine of claim 8, wherein the tub door includes a push roller provided on an outer surface of the tub door to push the cabinet door.

10. The washing machine of claim 6, wherein the tub includes a tub door lock to keep the tub door in a locked state, and the tub door lock locks the tub door by rotation of the cabinet door in a closing direction.

11. The washing machine of claim 10, wherein the tub door lock locks the tub door after the cabinet door is locked by the cabinet door lock as the cabinet door presses the tub door.

12. The washing machine of claim 11, wherein the cabinet door lock moves the cabinet door so that the cabinet door is spaced apart from the tub door after the tub door is locked.

13. The washing machine of claim 1, wherein the tub door lock is connected to the tub door lock releaser via a tensile cable.

14. The washing machine of claim 13, wherein the tub door lock releaser comprises a solenoid, which is actuated in response to a signal from the lock release switch, and a rotator, which is moved when the solenoid is activated, and the tensile cable is connected to the rotator to release the locked state of the tub door lock when the rotator is moved.

* * * * *